US011697990B2

(12) United States Patent
Seren et al.

(10) Patent No.: US 11,697,990 B2
(45) Date of Patent: Jul. 11, 2023

(54) METHODS AND SYSTEMS TO DETECT AN UNTETHERED DEVICE AT A WELLHEAD

(71) Applicant: Saudi Arabian Oil Company, Dhahran (SA)

(72) Inventors: Huseyin Rahmi Seren, Houston, TX (US); Max Deffenbaugh, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/568,485

(22) Filed: Jan. 4, 2022

(65) Prior Publication Data

US 2022/0127953 A1 Apr. 28, 2022

Related U.S. Application Data

(63) Continuation of application No. 16/907,064, filed on Jun. 19, 2020, now Pat. No. 11,242,743.

(60) Provisional application No. 62/864,959, filed on Jun. 21, 2019.

(51) Int. Cl.

| | |
|---|---|
| ***E21B 47/095*** | (2012.01) |
| ***E21B 34/14*** | (2006.01) |
| *E21B 31/03* | (2006.01) |

(52) U.S. Cl.

CPC ..... *E21B 47/095* (2020.05); *E21B 34/14* (2013.01); *E21B 31/03* (2013.01)

(58) Field of Classification Search

CPC ..... E21B 47/00; E21B 47/006; E21B 47/09; E21B 47/095; E21B 47/12; E21B 47/138

See application file for complete search history.

(56) References Cited

U.S. PATENT DOCUMENTS

| | | | |
|---|---|---|---|
| 6,241,028 | B1 | 6/2001 | Bijleveld et al. |
| 6,634,426 | B2 | 10/2003 | Mccoy et al. |
| 6,745,833 | B2 | 6/2004 | Aronstam et al. |
| 7,322,416 | B2 | 1/2008 | Burris et al. |
| 7,387,165 | B2 | 6/2008 | Lopez et al. |
| 9,863,222 | B2 | 1/2018 | Morrow et al. |
| 10,253,622 | B2 | 4/2019 | Jaaskelainen et al. |
| 10,400,584 | B2 | 9/2019 | Palomarez |
| 2003/0052670 | A1 | 3/2003 | Miszewski |

(Continued)

FOREIGN PATENT DOCUMENTS

| | | | |
|---|---|---|---|
| GB | 2306657 | A | 5/1997 |
| WO | 2019195923 | A1 | 10/2019 |

OTHER PUBLICATIONS

International Search Report and Written Opinion for International Application No. PCT/US2020/038859 (SA51049), report dated Sep. 16, 2020; pp. 1-14.

(Continued)

*Primary Examiner* — Kristyn A Hall

(74) *Attorney, Agent, or Firm* — Fish & Richardson P.C.

(57) ABSTRACT

Provided here are methods and system to detect an untethered device in a wellhead. The untethered device includes a housing, a transducer, and one or more sensors configured to measure data along the subterranean well. The transducer emits acoustic signals that are received by microphones on the surface of the wellhead. Based on these acoustic signals, the location of the untethered device is determined and appropriate valves may be opened or closed by an operator.

14 Claims, 4 Drawing Sheets

(56) References Cited

U.S. PATENT DOCUMENTS

| | | | | |
|---|---|---|---|---|
| 2003/0233873 | A1 | 12/2003 | Standen | |
| 2004/0108110 | A1* | 6/2004 | Zupanick | E21B 47/09 166/245 |
| 2006/0090893 | A1 | 5/2006 | Sheffield | |
| 2007/0051512 | A1 | 3/2007 | Markel et al. | |
| 2008/0008043 | A1 | 1/2008 | Jong | |
| 2011/0264429 | A1* | 10/2011 | Lee | E21B 47/022 703/10 |
| 2013/0118807 | A1* | 5/2013 | Yang | G01V 1/50 175/24 |
| 2016/0168984 | A1* | 6/2016 | Fripp | E21B 47/00 367/83 |
| 2016/0194954 | A1* | 7/2016 | Hay | G01V 3/30 367/82 |
| 2016/0320769 | A1* | 11/2016 | Deffenbaugh | E21B 47/06 |
| 2018/0328170 | A1 | 11/2018 | Jaaskelainen et al. | |

OTHER PUBLICATIONS

Liu et al., "Acoustic Wave-Based Method of Locating Tubing Leakage for Offshore Gas Wells", Energies, MDPI, 2018, 11, 3454.

* cited by examiner

| 302 | 304 | 306 | 308 | 330 | 332 | 336 |
|---|---|---|---|---|---|---|
| | | | | 0 | X | 0 |
| | | | | 1 | X | 0 |
| | | | | X | 0 | 1 |
| | | | | X | 1 | 1 |

METHODS AND SYSTEMS TO DETECT AN UNTETHERED DEVICE AT A WELLHEAD

CROSS REFERENCE TO RELATED APPLICATION

This application is a continuation of, and claims priority to and the benefit of, co-pending U.S. application Ser. No. 16/907,064 filed Jun. 19, 2020, titled "Methods And Systems To Detect An Untethered Device At A Wellhead," which claims priority to U.S. Provisional Application Ser. No. 62/864,959, filed Jun. 21, 2019, titled "Methods And Systems To Detect An Untethered Device At A Wellhead," the full disclosure of each of which is hereby incorporated herein by reference in its entirety for all purposes.

BACKGROUND OF THE DISCLOSURE

Field

This disclosure relates to methods, devices, and systems for detecting untethered devices at a wellhead of a subterranean well.

Description of Related Art

Measurement of downhole properties along a subterranean well is critical to the drilling, completion, operation, and abandonment of wells. These wells may be used for recovering hydrocarbons from subsurface reservoirs, injecting fluids into subsurface reservoirs, and monitoring the conditions of subsurface reservoirs. Downhole properties along a well are measured conventionally using tethered logging tools, which are suspended on a cable and lowered into the wellbore using, for example, a winch mounted in a logging truck and a crane. In some cases, the conventional tethered logging tools are pushed into the wellbore using, for example, coiled tubing. In other instances, tethered logging tools may be pushed or pulled along the wellbore using a tractor or other similar driving mechanism. Conventional tethered logging tools and the cable or wiring attached thereto are generally bulky and require specialized vehicles or equipment and a specialized crew of technicians to deploy and operate. A lubricator and additional blow out preventers are also needed to insert such tools in a pressurized well as a freely moving wire extends outside. Untethered miniature autonomous downhole devices remove the need for the wire and thus the lubricator, blow out preventer, winch, truck, and service crew. These devices can travel inside a well using gravity, buoyancy, fluid flow, or active propulsion. However, these devices need a deployment and recovery method for pressurized wells. Particularly, an operator needs information if an untethered logging tool has successfully passed through the valve assembly on the wellhead when it goes into well and when it comes back to surface.

SUMMARY

Various embodiments of the methods and systems for detection of an untethered device in a wellhead were developed to address these shortcomings in the art. One such system includes (a) an untethered device containing a microprocessor, a transducer, a housing, and a sensor configured to measure data along a subterranean well, where the microprocessor is operable to control the transducer; (b) a microphone operable to receive acoustic signals from the transducer; and (c) a receiver electronic circuit operable to process the acoustic signals received by the microphone and determine location of the untethered device within the wellhead.

The data from the sensor can include one or more physical, chemical, geological, or structural properties along the subterranean well or dynamics of the untethered device. Certain systems can also include a visual indicator responsive to the receiver electronic circuit that presents location of the untethered device to an operator. In certain embodiments, the microprocessor is responsive to a second sensor indicating presence of the untethered device inside or close to the wellhead.

In alternate embodiments, the untethered device can further include an actuator configured to change at least one of a buoyancy and a drag of the untethered device. The untethered device can have a buoyancy center that is located uphole of a gravity center, and the transducer can be located downhole of the gravity center.

In other alternate embodiments, a plurality of microphones can be arranged in a vicinity of a plurality of valves controlling a flow of a fluid in the wellhead. The plurality of valves controlling the flow of the fluid in the wellhead can include one or more of a crown valve, a production wing valve, and a master valve. The wellhead can include a plurality of valves that are operable to be controlled by at least one of a motor and an actuator. In yet other alternate embodiments, a wireless transmitter of a receiver unit can be operable to transmit a signal from the microprocessor of the receiver unit to a remote wireless receiver.

Also provided here are methods for determining location of an untethered device in a wellhead. One such method includes the steps of determining, by a microprocessor in the untethered device, the presence of the untethered device inside or close to the wellhead in response to data received by a sensor in the untethered device. In the next step, the microprocessor activates a transducer in the untethered device to produce an acoustic signal. A microphone on a surface of the wellhead receives the acoustic signals from the transducer. Then, the acoustic signal is amplified and modulated to produce an audible signal. Finally, the untethered device can be recovered from the wellhead by manipulation of a valve controlling the flow of a fluid in the wellhead.

In an embodiment, the location of the untethered device can also be presented to an operator by use of a visual indicator responsive to the acoustic signals received by the microphone. The valve controlling the flow of the fluid in the wellhead can be one or more of a combination of a crown valve, a production wing valve, or a master valve.

In other alternate embodiments, there can be a plurality of the valves controlling the flow of the fluid in the wellhead, and a plurality of the microphones. The plurality of the microphones can be arranged in a vicinity of the plurality of the valves controlling the flow of the fluid in the wellhead. The untethered device can be responsive to pressure at the wellhead being in excess of a pressure outside the wellhead. The untethered device can have a buoyancy center that is located uphole of a gravity center, and the method can further include locating the transducer downhole of the gravity center of the untethered device Another method for determining a location of an untethered device in a wellhead includes the steps of determining, by a microprocessor in the untethered device, the presence of the untethered device inside or close to the wellhead in response to data received by a sensor in the untethered device. In the next step, the microprocessor activates a transducer in the untethered device to produce an acoustic signal. The acoustic signal from the transducer is received by the microphone on a surface of the wellhead. The acoustic signal received by the microphone is transformed to produce a visual signal. Finally, the untethered device can be recovered from the wellhead by manipulation of a valve controlling the flow of a fluid in the wellhead.

In alternate embodiments, the valve controlling the flow of the fluid in the wellhead can be one or more of a combination of a crown valve, a production wing valve, or a master valve. The untethered device can be responsive to a pressure at the wellhead being in excess of a pressure outside the wellhead. There can be a plurality of the valves controlling the flow of the fluid in the wellhead, and a plurality of the microphones, wherein the plurality of microphones can be arranged in a vicinity of the plurality of valves controlling flow of a fluid in the wellhead. The valves can be automatically controlled by the receiver unit to deploy and retrieve the untethered device.

In other alternate embodiments, a method for detection of the presence of an untethered device in a wellhead includes determining, by a microprocessor in the untethered device, a presence of the untethered device inside or close to the wellhead in response to data received by a sensor in the untethered device. A transducer in the untethered device is activated by the microprocessor in the untethered device to produce an acoustic signal. A microphone on a surface of the wellhead receives the acoustic signal from the transducer. The acoustic signal received by the microphone is processed by a microprocessor of a receiver unit to determine if the untethered tool is present in the wellhead. A wireless signal is transmitted to a user to notify the presence of the device in the wellhead.

Numerous other aspects, features, and benefits of the present disclosure may be apparent from the following detailed description taken together with the drawings. The systems can include less components, more components, or different components depending on the process.

BRIEF DESCRIPTION OF THE DRAWINGS

While this disclosure is susceptible to various modifications and alternative forms, specific embodiments are shown by way of example in the drawings and will be described in detail here. The drawings may not be to scale. It should be understood, however, that the drawings and the detailed descriptions thereto are not intended to limit the disclosure to the particular form disclosed, but, to the contrary, the intention is to cover all modifications, equivalents, and alternatives falling within the scope of the present disclosure as defined by the appended claims.

DETAILED DESCRIPTION

Figure 1:
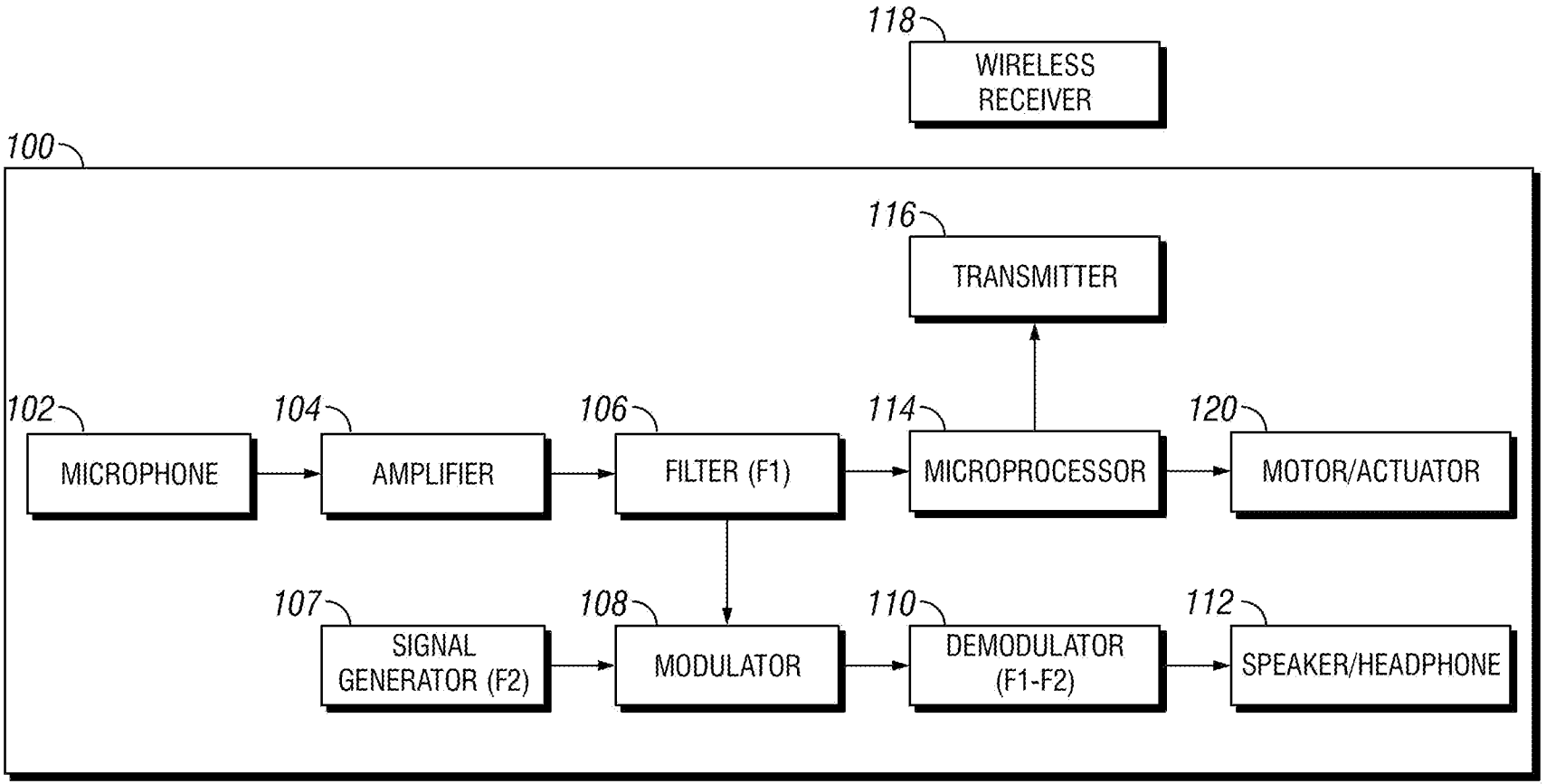
FIG. 1 is a schematic representation of a receiver unit, according to an embodiment.

In the following description, numerous specific details are set forth in order to provide a thorough understanding of the various embodiments. In other instances, well-known processes and methods may not be described in particular detail to avoid unnecessary obscuring of the embodiments described here. Additionally, illustrations of embodiments here may omit certain features or details in order to avoid unnecessary obscuring of the embodiments described here.

In the following detailed description, reference is made to the accompanying drawings that form a part of the specification. Other embodiments may be utilized, and logical changes may be made without departing from the scope of the disclosure. Therefore, the following detailed description is not to be taken in a limiting sense. The description may use the phrases "in various embodiments," "in certain embodiment," or "in embodiments," which may each refer to one or more of the same or different embodiments. Furthermore, the terms "comprising," "containing," "including," "having," and the like, as used with respect to embodiments of the present disclosure, are synonymous.

As a safety precaution in a pressurized well's wellhead or in a Christmas tree, usually at least two stages of barriers, such as valves and caps, are required between high and low pressure regions, such as between the inside and the outside the well. A "Christmas tree" as used here is an assembly of valves, spools, pressure gauges, and chokes fitted to the wellhead of a well. For fluid topped wells, an untethered device can be deployed and retrieved using the wellhead by sequentially opening and closing cascaded valves and allowing the device to pass through each valve stage by stage. However, an indicator for the device position inside the wellhead is needed to inform the operator about which valve should be opened or closed. Such an indicator can serve another purpose by also informing the operator when the device has successfully passed through the valve assembly on the wellhead when it goes into well and when it comes back to surface.

Embodiments of the disclosure provide for an acoustic signal-based method of determining the location of an untethered device along a wellhead. Embodiments further provide that when there is fluid flow within the well (such as when drilling mud is circulating during the drilling of the well, or when fracturing fluid is being pushed into the well during hydraulic fracturing, or when hydrocarbons are being produced out of the well), the location of the untethered device can be controlled by adjusting the drag of the device. In an embodiment, the untethered device is a device adapted to move by adjusting buoyancy and drag. In an embodiment, the untethered device is a device adapted to move by other locomotion adaptors, such as wheels, legs, or propellers. Accordingly, embodiments include an untethered, buoyancy-controlled or drag-controlled device configured to measure one or more physical, chemical, geological, or structural properties along a well. In operation, according to at least one embodiment, the untethered device is deployed and recovered at a top surface of a subterranean well. In various embodiments, the top surface of the well refers to a position near the surface of the earth, the wellhead, or the top of the liquid within the well, which may be some distance below the surface of the earth.

For untethered devices, the wellbore or the casing or tubing within the wellbore will exert forces on the untethered device as it travels along the well, such that the untethered device follows the trajectory of the well bore and measurements made by the untethered device are made at locations along the trajectory of the well. In an embodiment, the detection system for the untethered device includes an indicator for the device position inside the wellhead that informs an operator about which valve should be opened or closed. Such an indicator serves a dual purpose by also informing the operator when the untethered device returns to the surface.

In an embodiment, the untethered device includes a transducer, which emits sound waves when the device is inside the wellhead. The sound waves are transmitted through a liquid inside the wellhead and then to the surface of the wellhead. These sound waves are detected by a microphone or a microphone array placed outside the surface of the wellhead at specific locations. A receiver electronic circuit processes the signals received by a microphone or microphone array and determines a position of the device. In an embodiment, data from two or more microphones are processed to determine position of the device. In an embodiment, a receiver electronic circuit processes the signals picked up by a microphone array and determines a position of the device.

In an embodiment, the untethered device has a transducer that is controlled by a microprocessor. The transducer can be a piezoelectric transducer. As a first step, the microprocessor determines whether the device is inside or close to the wellhead based on the measurements done by internal sensors in the untethered device. For example, these measurements can be temperature, or pressure levels, or time derivative of these measurements that are indicative of location inside the wellhead. Once the microprocessor determines that the device is inside, the microprocessor activates a circuitry. In an embodiment, the circuitry drives the transducer at a predetermined frequency or automatically tunes to resonance frequency of the transducer. The sound waves are transmitted through the liquid in the wellhead and they are partially transmitted into the solid body of the wellhead. The fraction of the wave that is transmitted into the solid body can be detected from outside the wellhead using a microphone, or a transducer, or an array of microphones. In an embodiment, the microphone can be optimized to be sensitive at the specific frequency range expected from the transmitter transducer and the receiver circuitry can filter frequency content outside the region of interest. The microphone output can be processed in different ways as discussed below.

In the embodiment of the receiver unit 100 shown in FIG. 1, an acoustic signal is detected by microphone 102 positioned at the wellhead. The detected signal can be amplified by amplifier 104 that is coupled to a filter 106. The filter 106 is employed to reject sound signals in a particular range of frequencies, while leaving sound signals in another range of frequencies unchanged. The filtered signal may have a central frequency (f1). Using a modulator 108, the filtered signal is then modulated with a periodic signal (f2) generated by a signal generator 107, such that the difference of frequencies of modulation signal and received signal ($|f2-f1|$) is in the range of audible frequencies, for example, in a range of 100 Hz to 20 kHz. Then, a demodulator 110 is used to filter expected audible signal spectrum whose amplitude depends on the received signal strength. This audible signal is fed to a speaker or headphone 112. The device position is determined by pressing a hand-held microphone unit against different locations on the wellhead and listening to the audio signal output (FIG. 1).

In certain embodiments, receiver unit 100 can also include microprocessor 114. Microprocessor 114 of the receiver unit can be used to provide a signal to transmitter 116 of the receiver unit. Transmitter 116 can be a wireless transmitter that can transmit a signal that is delivered from microprocessor 114 of the receiver unit to a remote wireless receiver 120. The remote wireless receiver can be a remote device that is available to an operator for receiving information from the receiver unit at any location that can receive a wireless signal. As an example, the wireless signal transmission standard may be based on a Bluetooth, wi-fi, or Global System for Mobiles standards, or may be based on other suitable wireless communication systems. Therefore an operator could receive the information by way of transmitter 116 and wireless receiver 120 at any location globally that is able to receive such a signal standard.

In alternate embodiments, microprocessor 114 of receiver unit 100 can also transmit instructions to a motor or actuator 120. The motor or actuator 120 can be part of receiver unit 100 or can be located apart from actuator unit 120 as a separate part of the wellhead. The motor or actuator can be used to move various valves of the wellhead between open and closed positions, based on instructions provided by microprocessor 114 of the receiver unit.

In certain embodiments, the untethered device is used to obtain measurements along producing wells, which are producing fluids from downhole for at least part of the time while the device is in the well. In certain embodiments, the untethered device is used to obtain measurements along pressurized wells that contain a pressure at the wellhead, which is (or may be) in excess of ambient pressure outside the wellhead. In an embodiment, the untethered device is inserted and recovered through a Christmas tree valve assembly found at the top of the wellhead. At the top of the Christmas tree is a tree cap. Below the well cap, there is generally a crown valve, which is closed during production, but is opened to access the production tubing for cleaning or running wireline devices. Below the crown valve is a T-junction where a production wing extends horizontally off the Christmas tree to carry produced fluids to the production facilities.

A production wing valve is normally open during production, but blocks flow through the production wing when closed. Below the production wing, a master valve is normally open during production, but can be closed to block fluids from coming up the well. In an embodiment, two components are added to deploy and recover the untethered device in a well with such a Christmas tree. First, a screen or short pipe section with slits is inserted through the crown valve into the Christmas tree, so that the screen or short pipe section with slits allows flow out through the production wing but will not allow the untethered device to pass out the production wing. Second, a sensor such as an acoustic detector is attached on the outer surface of the Christmas tree near the production wing which detects the presence of the untethered device in the production wing, for example by detecting an acoustic transmission from the untethered device.

To begin deployment of the untethered device, the master valve and production wing valves are closed. The untethered device is inserted in the well after opening the tree cap, which is then subsequently closed. The untethered device falls on top of the crown valve. The crown valve is opened to allow the device to fall on top of the master valve and closed. The master valve is then opened allowing the untethered device to fall into the well. If the measurements are to be made during production, the production wing valve is opened to allow production to resume. When the untethered device returns to the surface, it will be trapped between the master valve and the crown valve and prevented from exiting the production wings by the screen. Once the presence of the untethered device is detected, the master valve and production wing valves are closed and the crown valve is opened. At this point, the untethered device is lifted inside the Christmas tree through the crown valve due to buoyancy. If there is accumulated gas above the crown valve, the gas can be bled through the relieve valve by opening the master valve and closing after relieving, or fluid can be added into the well from outside, in order to lift an untethered buoyant tool. Finally, all valves are closed, and the tool is retrieved by opening the tree cap.

The opening and closing of the valves of the Christmas tree can be performed by a motor or actuator. For example, the microprocessor of the receiver unit can determine the correct sequence for opening and closing the valves of the Christmas tree of the wellhead assembly that is required to deliver an untethered device into the wellbore through the Christmas tree or to retrieve the untethered device out of the wellbore from the Christmas tree. The motor or actuator can be controlled automatically by the microprocessor of the receiver unit so that the valves of the Christmas tree are opened and closed without operator intervention.

Figure 2:
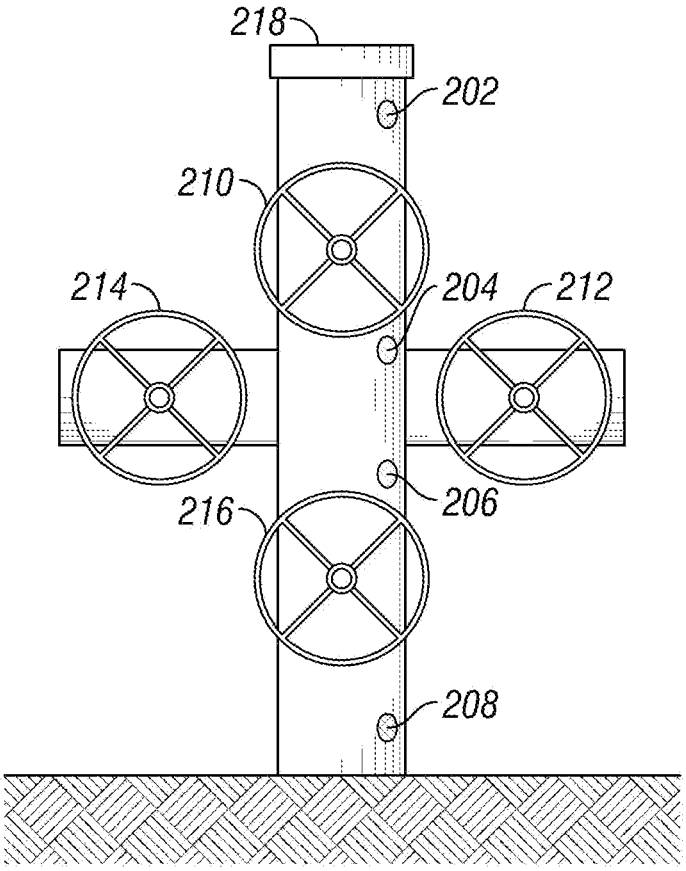
FIG. 2 is a schematic representation of a microphone array distributed at different locations on a wellhead, according to an embodiment.
Figure 3:
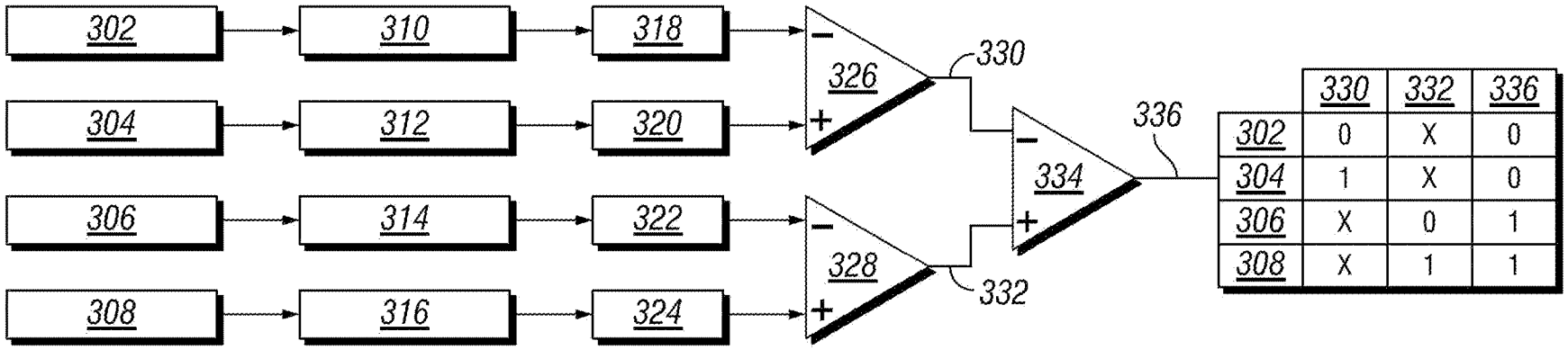
FIG. 3 is a schematic representation of the processing of signals from a microphone array distributed at different locations on a wellhead, according to an embodiment.

In an embodiment shown in FIG. 2, a microphone array, containing four microphones 202, 204, 206, and 208, is distributed across different locations on a wellhead. In an embodiment, the microphones are placed in vicinity of a plurality of valves controlling flow of a fluid in the wellhead. In the embodiment shown in FIG. 2, the microphones 202 and 204 are located around the crown valve 210. The microphones 204 and 206 are located proximal to a first production wing valve 212 and the microphones 204 and 206 are located distal to a second production wing valve 214. The microphones 206 and 208 are located around a master valve 216. The signals received by each microphone are amplified and rectified to create direct current (DC) signals with amplitudes correlated to the received signal strengths. These DC signals can be compared in several ways to detect the position of the device. For example, analog comparator integrated circuits can be used in a cascaded fashion and a truth table can be used to find the untethered device's closest position. In this embodiment, the indication for the operator can be visual, such as a light emitting diode or an LCD screen. An example for four microphones is shown in FIGS. 2 and 3. The tree cap 218 on top of the Christmas tree provides access to the wellhead for retrieval of the untethered device.

In an embodiment shown in FIG. 3, four microphones 302, 304, 306, and 308 are distributed across different locations on a wellhead. These microphones are each coupled to four amplifiers 310, 312, 314, and 316, and four filters 318, 320, 322, and 324, respectively. The filters 318 and 320 are coupled to a comparator 326, and filters 322 and 324 are coupled to a comparator 328. The outputs 330 and 332 from the comparators 326 and 328 are inputs to the comparator 334 to produce an output 336. Comparators produce a digital output signal that can take a high or low voltage value that can be represented as 1 and 0, respectively. The input from the four microphones 302, 304, 306, and 308 are evaluated against the digital outputs 330, 332, and 336 from the comparators 326, 328, and 334, as shown in the truth table in FIG. 3. The truth table indicates which microphone is the closest to the untethered device. For example, if the digital output 330 is high and digital output 336 is low, the untethered tool must be closer to the position of microphone 304 than to the position of microphones 302, 306, or 308.

In an embodiment, signals from several microphones can be input to a microprocessor. The microprocessor can use an algorithm based on a truth table similar to one shown in FIG. 3 to evaluate and determine the location of the untethered device. Then, the microprocessor can provide the location information to an operator. Alternatively, the microprocessor can use motors or actuators to open and close the valves on the Christmas tree and allow the untethered device to pass through the valves.

Figure 4:
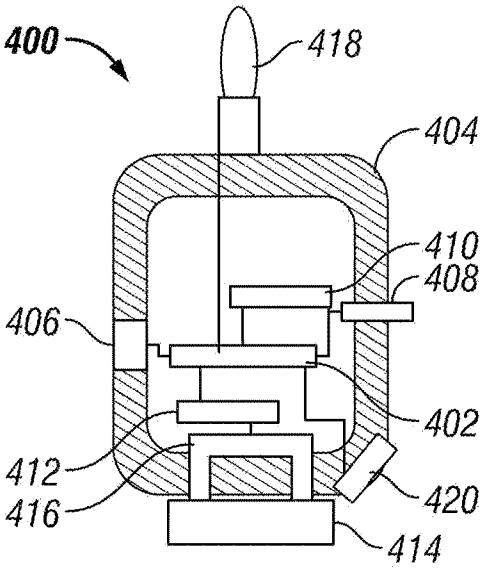
FIG. 4 is a schematic section view of an untethered device, according to an embodiment.

In an embodiment shown in FIG. 4, the untethered device 400 with the acoustic transducer and associated circuitry 402 is fashioned with lightweight materials and includes a housing 404. Housing 404 is formed of a material that can insulate electrical components that are part of the untethered device 400. Housing 404 can provide a barrier against high pressure outside, or it can be filled with a liquid or elastomer to compensate the pressure differential.

One or more sensors 406, 408 provide information to the microprocessor of the circuitry 402 in the untethered device about the location of the untethered device 400 in the wellhead. For example, these sensors 406, 408 could measure temperature or pressure levels, or time derivative of these measurements, or number of casing collars passed during descent and ascent. One of the sensors 406, 408 can detect a physical signature inside a wellhead such as electric, magnetic or acoustic signals that naturally exist or induced externally that indicate presence inside the wellhead. The sensors 406, 408 can alternately be configured to measure data along the subterranean well. The data includes one or more physical, chemical, geological, or structural properties along the subterranean well.

In an embodiment, a magnetic field is induced inside the wellhead by attaching a strong permanent magnet or electromagnet outside the wellhead, where the magnetic field amplitude inside the wellhead becomes larger than a threshold value, where the threshold value is larger than the Earth's and wellhead's magnetic field. For example, a strong neodymium magnet can be attached below the master valve to increase the magnetic field inside the wellhead. The untethered device can have a magnetic sensor that can detect the magnetic field and the microprocessor inside the untethered device can determine its presence inside the wellhead based on the strength of the measured magnetic field.

The untethered device 400 further includes a processor of the circuitry 402 configured to read the one or more of the sensors 406, 408. Circuitry 402 can also be used to measure the data and to store the measured data. The processor of circuitry 402 can be used to execute preprogramed commands for the operation of the untethered device 400. A transmitter of the circuitry 402 is configured to transmit the measured data to a remote receiver arranged external to the subterranean well. Power supply 410 can provide the necessary power to the components of untethered device 400, including circuitry 402.

Further, the untethered device 400 includes a controller 412 configured to control at least one of a buoyancy and a drag of the untethered device 400 to control a position of the untethered device 400 along the subterranean well.

According to an embodiment, the controller 412 includes an actuator, which triggers a change in the buoyancy or the drag or both, when activated by an electrical signal from the processor. In another embodiment, the controller includes a chemical or mechanical process, which causes the change in the buoyancy or the drag or both, independent of any electrical signal from the processor. Examples of such processes include a dissolution of a weight after a certain time, a state change (and associated density change) of a compound at a temperature that corresponds to a certain position along the well, or a compression or a breaking of a mechanical linkage at a pressure that corresponds to a certain position along the well. The processor includes instructions defining measurement parameters for the sensors of the untethered device within the subterranean well.

In the example embodiment of FIG. 4, the untethered device 400 includes a weight 414, which is denser than the rest of the apparatus, and a weight securing means 416 for securing and releasing the weight to and from the untethered device 400 to change the buoyancy of the apparatus to control a position or a direction of motion of the apparatus along the subterranean well. The actuator of controller 412 can be used to signal the weight securing means 416 to release the weight 414 to change the buoyancy of the apparatus.

In an alternate embodiment, one or more fins 418 can be attached to the untethered device 400 and the controller 412 can be used for deploying and retracting the fin 418. When the fin 418 is deployed, there is an increased drag on the apparatus from the flow along the well and when the fin 418 is retracted (as shown in FIG. 4), there is a reduced drag on the apparatus from the flow along the well. In one embodiment, the apparatus is sufficiently heavy to descend in the well when the fin 418 is retracted despite an upward flow along the well of produced fluids, while the increased drag when the fin is deployed is sufficient to cause the apparatus to ascend in the well. In one embodiment, the apparatus changes both the drag, for example, by deploying at least one fin 418, and the buoyancy, for example, by dropping a weight 414, in order to change its trajectory from descending to ascending.

Figure 5:
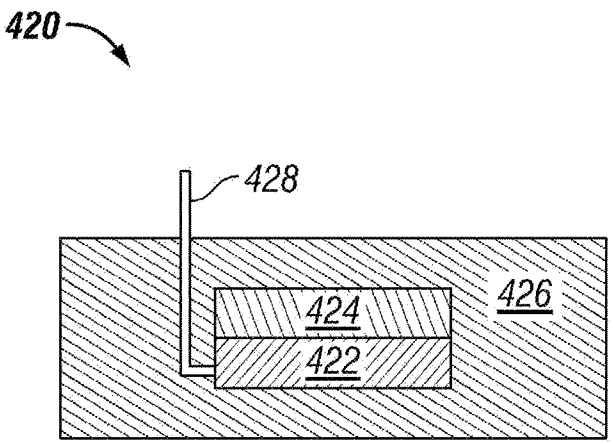
FIG. 5 is a schematic section view of an acoustic transmitter of an untethered device, according to an embodiment.

The untethered device 400 further includes an acoustic transmitter 420. Looking at FIG. 5, acoustic transmitter 420 can generate acoustic signals by applying electrical signals to an electroacoustic transducer 422. Electroacoustic transducer 422, can be for example, a piezo device. A reflector plate 424 is placed on one side of the electroacoustic transducer 422 to concentrate the acoustic energy on the side that contacts the liquid phase of the fluid within the well. The reflector plate 424 can be made out of various metals such as steel. The thickness of the reflector plate 424 can be ideally a quarter of a wavelength of the acoustic wave inside the reflector plate 424. This ensures fully constructive interference of the reflected signals.

The electroacoustic transducer 422 can be encapsulated in a potting material 426, such as an elastomer (e.g. polyurethane, polydimethylsiloxane), to insulate the transducer from conductive fluids and create a chemical protection barrier against corrosion of metal parts. As an example, elastomers such as urethane can be used to insulate and protect electrodes of electroacoustic transducer 422. Elastomers can also provide a good acoustic impedance matching with fluids. An electrical feed through 428 may be needed from the acoustic transmitter to the electrical circuitry to drive the transducer.

Figure 6:
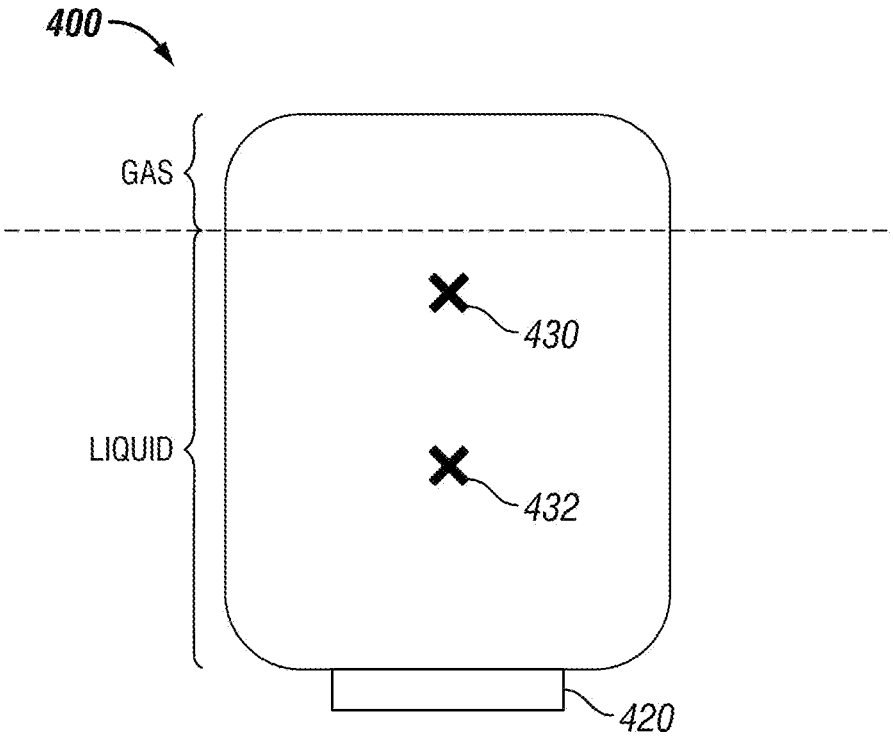
FIG. 6 is a schematic side view of an untethered device, according to an embodiment.

Looking at FIG. 6, an example embodiment of untethered device 400 has a buoyancy center 430 and gravity center 432 that are not overlapping due to varying density within the device. Such an arrangement creates a righting moment until the device orients itself with respect to the gravitational axis. In embodiments of the untethered device 400, the acoustic transmitter 420 is placed on the denser side of untethered device 400 so that the acoustic transmitter 420 is located on a downhole side of the untethered device 400. Therefore, the untethered device 400 will maintain an orientation where the buoyancy center 430 is uphole of the gravity center 432, and the acoustic transmitter 420 will be located downhole of the gravity center 432. If there is a gas cap at the top of the well, the acoustic transmitter 420 can stay in contact with the liquid phase in the well, such as a water or an oil.

The output impedance of acoustic transmitter 420 can be matched to the acoustic impedance of the liquid phase, and can stay in contact with the liquid so that most of the emitted sound waves are transmitted into the liquid phase with minimum reflection. The sound waves can travel through the liquid phase and reach to the metal parts of the Christmas tree. The sound waves are conducted by the metal parts of the Christmas tree and to the outside of the Christmas tree where the detector, such as a microphone, is placed.

In one embodiment, the untethered device has active locomotion means to descend, ascend, and move inside deviated or horizontal wells. These may include one or more of tracks, wheels, legs, and propellers.

Provided here is also a method for determining the location of an untethered device that is adapted to measure properties at one or more specified locations along a subterranean well. In an embodiment, the method includes the steps of programming movement of an untethered device along a subterranean well. A direction of motion of the untethered device along the subterranean well is controlled by changing a buoyancy or a drag of the untethered device when a certain condition occurs. The method further includes releasing the programmed untethered device into the subterranean well, such that the untethered device descends in the subterranean well, and recovering the untethered device from the subterranean well after the untethered device changes the buoyancy or the drag or both and ascends to the wellhead of the subterranean well. A microprocessor in the untethered device determines whether the device is inside or close to the wellhead based on the measurements done by internal sensors in the untethered device. Once the microprocessor determines that the device is inside, the microprocessor activates the transducer at a predetermined frequency or automatically tunes to resonance frequency of the transducer. The transducer emits acoustic signals that are detected by microphones placed on the surface of the wellhead. Further, the method includes measuring and recording the data in the subterranean well during the descent or the ascent of the untethered device in the subterranean well, and downloading the recorded data to an external processor. This measured data includes, for example, one or more physical, chemical, geological, or structural properties along the subterranean well or dynamics of the untethered device itself within the well from which fluid or flow properties is determined. Further, according to at least one embodiment, the method includes associating the data with a position along the subterranean well. In an embodiment, a plurality of measurements are recorded and associated with their respective positions along the subterranean well.

Also provided here is a method for measuring properties along a subterranean well, including the step of programming an untethered device for operation along a subterranean well, and specifying sensor measurements that are to be acquired, locations, or times at which the sensor measurements are to be acquired, and conditions upon which the untethered device will change a buoyancy or a drag or both. Further, the method includes measuring and recording the data along the subterranean well during at the descent or the ascent of the untethered device in the subterranean well, and downloading the recorded data to an external processor. This measured data includes, for example, one or more physical, chemical, geological, or structural properties along the subterranean well or dynamics of the untethered device itself within the well from which fluid or flow properties are inferred. Further, the method includes associating the data with a location based on a trajectory of the well and a second measurement that constrains position on that trajectory. The location of the untethered device inside the well can be based on casing collar locator carried by the untethered device. The location of the untethered device at the wellhead is determined based on acoustic signals emitted by a transducer in the untethered device.

Provided here is an untethered device for measuring properties along a subterranean well and transmitting its location using acoustic signals when it is in the wellhead. The untethered device includes a housing, a transducer, and one or more sensors configured to measure data along the subterranean well. The data includes one or more physical, chemical, geological, or structural properties along the subterranean well. The untethered device further includes one or more processors configured to control the one or more sensors measuring the data and to store the measured data. The processor controls the transducer and determines whether the device is inside or close to the wellhead based on the measurements done by internal sensors in the untethered device. Once the processor determines that the device is inside, the microprocessor activates a circuitry. In an embodiment, the circuitry drives the transducer at a predetermined frequency or automatically tunes to resonance frequency of the transducer. The sound waves are transmitted through the liquid in the wellhead and they are partially transmitted to the solid body of the wellhead. The fraction of the wave that is transmitted to the solid body can be detected from outside the wellhead using a microphone, or a transducer, or an array of microphones. The processor includes instructions that define the measurement parameters for the one or more sensors of the untethered device within the subterranean well. The untethered device further includes a transmitter configured to transmit the measured data to a receiver arranged external to the subterranean well, and a controller configured to control buoyancy or drag or drag of the untethered device to control a position of the untethered device along the subterranean well. The untethered device further includes a non-transitory computer-readable medium in communication with the one or more processors having computer-readable instructions stored therein that when executed cause the untethered device to control a transducer and be responsive to internal sensors.

In one embodiment, the receiver unit has one or more microphones, a microprocessor, and a wireless transmitter. The microprocessor of the receiver unit processes the data coming from the microphones and decides if the untethered tool has arrived back to the Christmas tree. If the tool is detected in the Christmas tree, the microprocessor sends a wireless signal to notify the user whereas the user has a wireless receiver. The wireless signal transmission standard may be based on for example, a Bluetooth, wi-fi, or Global System for Mobiles standard, or may be based on other suitable wireless communication system.

In one embodiment, the operation of the valves on the Christmas tree are automated. The valves can be controlled by the microprocessor on the receiver unit through motors or by actuators. The microprocessor of the receiver unit processes the data coming from the microphones and decides if the untethered tool has arrived back to the Christmas tree. The microprocessor opens and closes the valves as described herein to automatically deploy the untethered device into the Christmas tree, retrieve the untether device from the Christmas tree, or both deploy the untethered device into and retrieve the untethered device from the Christmas tree.

The foregoing descriptions of methods, devices, and results obtained using them are provided merely as illustrative examples. Descriptions of the methods are not intended to require or imply that the steps of the various embodiments must be performed in the order presented. As will be appreciated by one of ordinary skill in the art, the steps in the foregoing embodiments may be performed in any order. Words such as "then" are not intended to limit the order of the steps; these words are simply used to guide the reader through the description of the methods. Many of the operations may be performed in parallel or concurrently. In addition, the order of the operations may be re-arranged. A process may correspond to a method, a function, a procedure, a subroutine, a subprogram, etc. Various modifications and alternative embodiments of various aspects of the devices and methods disclosed here will be readily apparent to those skilled in the art, and the general principles provided here may be applied to other embodiments without departing from the spirit or scope of the disclosure.

What is claimed is:

1. A system for detection of an untethered device in a wellhead, the system comprising:

the untethered device containing a microprocessor, a transducer, a housing, and a sensor configured to measure data along a subterranean well, the microprocessor operable to control the transducer;

a plurality of microphones arranged outside of the wellhead on a surface of the wellhead in a vicinity of a plurality of valves controlling flow of a fluid in the wellhead, the plurality of microphones operable to receive acoustic signals from the transducer; and a receiver electronic circuit operable to process the acoustic signals received by the plurality of microphones and to determine a microphone of the plurality of microphones that is closest to a location of the untethered device within the wellhead.

2. The system of claim 1, where the plurality of valves controlling flow of the fluid in the wellhead includes one or more of a crown valve, a production wing valve, or a master valve.

3. The system of claim 1, where the sensor is operable to measure the number of casing collars passed during descent and ascent of the untethered device within the subterranean well.

4. The system of claim 1, where the untethered device has a buoyancy center that is located uphole of a gravity center, and where the transducer is located downhole of the gravity center.

5. The system of claim 1, where the transducer is part of an acoustic transmitter, and where the acoustic transmitter is operable to generate the acoustic signals by applying electrical signals to the transducer, and where an impedance of the acoustic transmitter is matched to an acoustic impedance of a liquid phase of the fluid within the wellhead.

6. The system of claim 1, where the untethered device further contains an actuator configured to change at least one of a buoyancy and a drag of the untethered device.

7. The system of claim 1, further including a visual indicator responsive to the receiver electronic circuit and presenting the location of the untethered device to an operator.

8. A method for determining a location of an untethered device in a wellhead of a subterranean well, the method comprising:

determining, by a microprocessor in the untethered device, a presence of the untethered device inside or close to the wellhead in response to data received by a sensor in the untethered device;

activating, by the microprocessor, a transducer in the untethered device to produce an acoustic signal;

receiving, with a microphone array of a receiver unit, the acoustic signal from the transducer, the microphone array comprising a plurality of microphones placed outside the surface of the wellhead at specific locations;

processing the acoustic signal with a microprocessor of the receiver unit to generate a signal for delivery to a wireless transmitter, the signal identifying a microphone in the microphone array that is closest to the untethered device; and transmitting the signal with the wireless transmitter to a remote wireless receiver to notify a user of the presence of the untethered device in the wellhead.

9. The method of claim 8, where the data received by the sensor in the untethered device is at least one of a pressure and a time derivative of the pressure within the subterranean well.

10. The method of claim 8, where the data received by the sensor in the untethered device is at least one of a temperature and a time derivative of the temperature within the subterranean well.

11. The method of claim 8, further including before processing the acoustic signal with the microprocessor of the receiver unit, amplifying the acoustic signal with an amplifier of the receiver unit.

12. The method of claim 8, further including before processing the acoustic signal with the microprocessor of the receiver unit, filtering the acoustic signal with a filter of the receiver unit, the filter of the receiver unit rejecting sound signals in a selected range of frequencies, while leaving sound signals in another range of frequencies unchanged.

13. The method of claim 8, where the transducer of the untethered device is automatically tuned to a resonance frequency of the transducer.

14. The method of claim 8, further including recovering the untethered device from the wellhead by manipulation of a valve controlling a flow of a fluid in the wellhead.

* * * * *